United States Patent [19]

Everroad

[11] 4,385,759

[45] May 31, 1983

[54] SKIP ROPE

[76] Inventor: James M. Everroad, 3601 Arlington, Columbus, Ind. 47201.

[21] Appl. No.: 270,575

[22] Filed: Jun. 4, 1981

[51] Int. Cl.[3] ..... A63B 5/20

[52] U.S. Cl. ..... 272/75; 273/DIG. 5; 273/DIG. 6; 273/DIG. 12

[58] Field of Search ..... 272/75, 74, 68, 67, 272/143; 46/1 G, 77; 74/551.9; D8/303; 116/63 P; 273/DIG. 5, DIG. 6, DIG. 12; 119/29; D3/12, 13; D21/198; D6/208.2; 308/20, 215, 216, DIG. 7; 19/128; 128/26, 57; 29/148.4 D

[56] References Cited

U.S. PATENT DOCUMENTS

| | | | |
|---|---|---|---|
| 579,774 | 3/1897 | Rugg | 74/551.9 |
| 708,216 | 9/1902 | Fowler, Jr. | 128/57 X |
| 938,348 | 10/1909 | Stull | 272/68 |
| 3,178,182 | 4/1965 | Ernst | 273/DIG. 6 |
| 3,415,515 | 12/1968 | Otto | 272/75 |
| 3,478,714 | 11/1969 | Keats | 116/63 P |
| 3,560,128 | 2/1971 | Carlton | 273/DIG. 6 |
| 4,136,866 | 1/1979 | Bouvier | 272/75 |
| 4,158,457 | 6/1979 | Hydro | 272/75 |
| 4,201,382 | 5/1980 | Wilson | 272/75 |
| 4,251,070 | 2/1981 | Leseberg | 272/143 X |

FOREIGN PATENT DOCUMENTS

| | | | |
|---|---|---|---|
| 1106485 | 7/1955 | France | 272/75 |

*Primary Examiner*—Richard C. Pinkham
*Assistant Examiner*—Arnold W. Kramer
*Attorney, Agent, or Firm*—Woodard, Weikart, Emhardt & Naughton

[57] ABSTRACT

A skip rope for exercise and fitness conditioning includes a length of polypropylene rope threaded through two handle members disposed at opposite ends of the length of rope. After the rope is threaded through each handle member, the free ends of the rope are knotted to prevent it from pulling back through the two handles. Each handle is constructed of a tubular section of polyvinylchloride which has nylon end plugs press fit into the open ends of the tube. The outside diameter surface of each end plug coincides with the outside diameter surface of the polyvinylchloride tubing and each end plug includes a rope-receiving clearance aperture just slightly larger than the outside diameter of the rope. The material combination of nylon for the end plug and polypropylene for the rope provides a type of self-lubricating interface which enables the rope to turn and twist completely independent of the handle. Further, this self-lubricating characteristic enables the rope to slide relative to the end plugs without wear or abrasion to any significant degree.

5 Claims, 4 Drawing Figures

SKIP ROPE

BACKGROUND OF THE INVENTION

The present invention relates in general to skip rope apparata and in particular to handle and rope construction both as to their structure and material which permit a less-expensive and more easily utilized arrangement.

Skip ropes, or alternatively jumping ropes, do not entail an overly complicated construction. In fact, although the more "polished" designs utilize handles, small children will play the games of jump or skip rope using only a length of rope with the free ends of the rope serving as handles. The most apparent disadvantage with this simplistic construction is the fact that the rope has a tendency to twist and turn and does not provide a suitable means for grasping since the rope turns in the hands of the user. In an effort to overcome the twisting rope problem, various attempts have been made to construct the handles so that they permit the rope to turn while the handles remain stationary. Although there may be a wide variety of ways in which to construct handles which permit the rope to turn while the handle remains stationary, the criteria of low cost and ease of construction are important so that such skip ropes would be easily affordable by all who wish to keep fit by such an exercise technique.

The following listed patents disclose various skip rope handle concepts and attachment means, and while each of these references may in fact disclose a construction which at the time of conception was deemed to be novel, none of the disclosures are believed to be anticipatory of the present invention in that they do not provide the same type nor convenience of construction provided by the disclosure of the present invention.

| U.S. Pat. No. | Patentee | Issue Date |
|---|---|---|
| 1,436,703 | Fisher | 11/28/22 |
| 1,508,300 | Sacks | 9/09/24 |
| 1,651,057 | Goldstein | 11/29/27 |
| 2,253,075 | Johnson | 8/19/41 |
| 4,101,123 | Anthony | 7/18/78 |
| 4,179,119 | Wolf | 12/18/79 |
| 4,201,382 | Wilson | 5/06/80 |

Fisher discloses a rope handle construction wherein a wooden turned handle is arranged with a generally spherical recess into which a ball is placed such that the ball is larger than the recess opening. The rope for the skip rope is inserted into the ball and knotted at the back side. Thus, the rope may turn relative to the ball and the ball may turn relative to the recess. Consequently, adequate bearing surfaces are provided which enable the rope to twist while the handles remain stationary. Although the particular shape, contour and material choice would appear to be a disadvantage, a more significant drawback of this construction is the fact that the handle must be fabricated in two sections and then glued or otherwise secured together. This particular construction concept precludes the use of conventional piece part shapes and if the skip rope breaks, an entirely new handle must be constructed.

Sacks discloses a tassle construction and although this reference is believed to be of only limited relevancy to the present invention, it is to be noted that a longitudinal passage 11 is provided entirely through mold 6 and a cord 15 is adapted to be passed through the mold and knotted as indicated by reference character 16. This particular construction regarding how the cord is passed through the mold and knotted may have some relevancy regarding the methods of securing a skip rope to its corresponding handle.

Goldstein discloses a skip rope construction wherein the end of a contoured wooden handle is provided with a recessed void into which the rope and a shouldered bearing sleeve are fitted. The enlarged portion of the shouldered sleeve rides against the inside surface at the end of the handle and provides a bearing action for the turning or twisting rope. This construction thus prevents wear and attempts to reduce the frictional contact between the rope and the wood handle. Again, the construction of the wooden handle is quite specialized and the assembly concept does not permit the user of the skip rope to make that change at the time of initial purchase. A further drawback would appear to be the degree of security regarding the clamping of the rope into the recessed void of the handle since this is accomplished by means of the shouldered bearing sleeve, any additional force exerted upon the rope would have a tendency to pull or strip out the rope from the sleeve and thus defeat the entire construction.

Johnson discloses a skip rope construction wherein the disclosed wooden handles are completely hollow and include a shouldered or counterbore portion internally. This counterbore provides a shouldered surface against which any enlarged attachment to the free end of the rope will ride thus preventing the rope from pulling out of the handle. What is very definitely lacking by this construction is any suitable bearing interface between the turning and twisting rope and the handle. In fact, what occurs in that as forces are exerted on the rope, the pressure against the counterbored shoulder becomes greater, thereby increasing the frictional forces at this interface.

Anthony discloses a jump rope construction which includes a connection between the rope and a pair of handles which includes a ball bearing assembly. The ball bearing assembly includes the balls and race which are disclosed by earlier technology and a housing having an outer flange and an inner shoulder defining therebetween a handle recess. The construction still relies on a clamping action around the free end of the rope in order to provide an enlarged diameter shape which is prevented from pulling through the inside diameter of the bearing and thus stripping it out of the handle. As with the prior art references to Goldstein and Johnson, any arrangement which simply clamps a cylindrical sleeve member or washer around the rope and then attempts to have that enlarged diameter abut against a shouldered surface is not as effective as some more positive retention means. As a skip rope is utilized, there are those times when tripping on the rope may exert a significant force longitudinally along the rope, causing the rope to strip out of the handles. Consequently, any suitable concept for securing the rope to the handles must be very durable and very positive and it is not believed that these crimping sleeve constructions are adequate for that intended purpose.

Wolf discloses a skip rope which employs a wire rope in combination with wooden handles in an arrangement which permits the handles to rotate freely with respect to the rope. The wooden handles include an axial bore which has a central section of reduced diameter in which is mounted a metal peg by means of a bushing supported inside the handle pore. The peg protrudes from the handle and engages a rope-accommodating part through which the rope may be looped. While this particular construction may offset certain earlier disadvantages, its construction is quite specialized and incorporates a large number of piece parts, all of which must be properly sized, toleranced and assembled in order to achieve a working unit.

Wilson discloses a skip rope which includes an elongated flexible element having first and second end portions and handles attached to the end portions. Each of the handles includes a tubular hand grip which has a passage opening at the inner end of the hand grip and a tubular retainer in the passage opening of the tube. The first end portion of the flexible element extends through the tube and is attached to a bearing. The bearing is retained in the passage opening of the hand grip between the outer end of the retainer and the transverse wall of the hand grip. Again, this particular construction relies on a ring crimped around the free end of the rope and which abuts against the face of the bearing. Although a knotted construction of some sort in disclosed in the FIG. 4 arrangement, that involves an intermediate component part of the overall apparatus and is not associated with the handle construction. These intermediate portions are actually weights and knot 71 is provided to fix the position of these weights to keep them from shifting longitudinally along the rope. The corresponding handle construction provides an overly complex system when it is realized that the primary purpose is simply to allow the rope to turn and twist independently of the handle.

While each of the above-listed patent references may, in a very crude sense, provide a means for the skip rope to turn and twist relative to the handle, none of the construction concepts are believed to be of an inexpensive, conveniently assembled, highly reliable and durable nature. However, each of these various advantages are realized by the teachings of the present invention as will be apparent from the following descriptions.

SUMMARY OF THE INVENTION

A skip rope with handles at each end, each of the handles having a longituddinal axis and according to one embodiment of the present invention comprises a hollow, generally cylindrical handlegrip member open at each end and defining a skip rope-receiving region therethrough and a pair of shouldered, generally cylindrical bearing members, each bearing member being arranged with a reduced-diameter plug portion and an enlarged-diameter head portion and adapted to be received by the handlegrip member, each of the bearing members defining a through hole adapted to receive the skip rope.

One object of the present invention is to provide an improved skip rope.

Related objects and advantages of the present invention will be apparent from the following description.

DESCRIPTION OF THE PREFERRED EMBODIMENT

Figure 1:
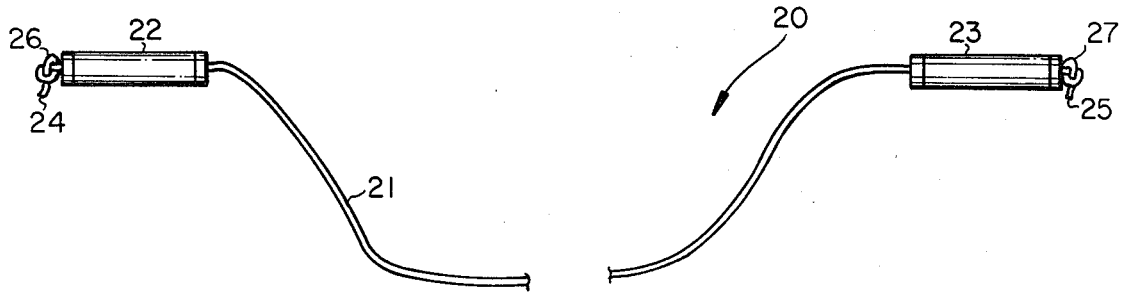
FIG. 1 is a perspective view of a skip rope according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a skip rope 20 which includes a length of rope 21, a first handlegrip member 22 at one end and a second handlegrip member 23 at the opposite end. The length of rope 21 has two free ends 24 and 25, respectively, and while the length of rope is permitted to extend through each of the handlegrip members, the rope is knotted at locations 26 and 27 at the outer end of each corresponding handlegrip member.

By structuring the clearance aperture through each handlegrip member such that it is just slightly larger than the outside diameter size of the length of rope, the existence of knots at locations 26 and 27 prevent the free ends of the length of rope 24 and 25 from pulling back through the handles. This particular construction concept is extremely simple and reliable, and if for any reason the rope becomes worn or breaks, the handlegrip members are unaffected. All that one must do to install a new length of rope is to thread the rope through the two corresponding handlegrip members and knot the rope at the outermost end, the skip rope is thereafter ready for use.

While there are believed to be a wide variety of handlegrip concepts for a skip rope, many of which have already been detailed in the background discussion of the present invention, one criteria and consideration omitted from all of this prior art is a means to fabricate the handles out of conventional material shapes and in a manner that provides extremely low cost yet high reliability and strength. A further consideration regarding the handle construction is to provide some type of bearing or lubricated interface between the handlegrip member and the rope so that as the rope turns and twists, the handlegrip members are unaffected. If such were not the case, then the rope would abraid more rapidly along the edge against which it rubs, and it would not provide as smooth of operation for the user since additional drag would be placed on the rope. Initially, skip rope handle designs focused on contoured wooden members and fairly complicated assembly procedures in order to provide some type of bearing surface. The drawback with these types of designs were of course the turning operations and contouring required for the handles, most of which were wooden, and the obvious inability to replace the handles in a convenient and low-cost fashion. If a wooden handle would break or otherwise be damaged, it must be completely remade and then reassembled. Similarly, if the rope would break, many of the handles could not be reused. However, a possibly more severe drawback with the wooden handle concepts was the inability to provide a bearing surface between the interface of the rope and the handle. Designs such as that of the Johnson Pat. No. 2,253,075 allow the rope to exit directly through an aperture in the wooden handle and thus the edges of the rope act directly against the edges of the wooden handle. This is the type of abrasive interface which is quite undesirable. In order to attempt to overcome this type of problem, certain earlier designs incorporated ball bearing inserts as part of the handle mechanism so that there would be greater freedom for the rope to turn relative to the handle. The drawback with this type of design is first of all the high cost of inserting bearings in skip rope handles and secondly, the somewhat involved structural arrangement which is necessary in order to receive in a properly aligned and secured fashion the ball bearing inner and outer races.

As an alternative to these somewhat unacceptable prior devices, the present invention incorporates readily available material shapes which to the extent necessary may be easily fabricated and very quickly assembled. Further, if any of the component piece parts become lost or damaged, they may be easily replaced and assembled. Another important aspect of the present invention is that the materials selected for the skip rope and the handlegrip members have a certain self-lubricating relationship to each other such that there is both less friction and less wear or abrasion at the interface between the rope and handlegrip members. Although there is believed to be a variety of handlegrip member arrangements in accord with the present invention which will satisfy the above objectives, two illustrations have been provided by FIGS. 2 and 3.

Figure 2:
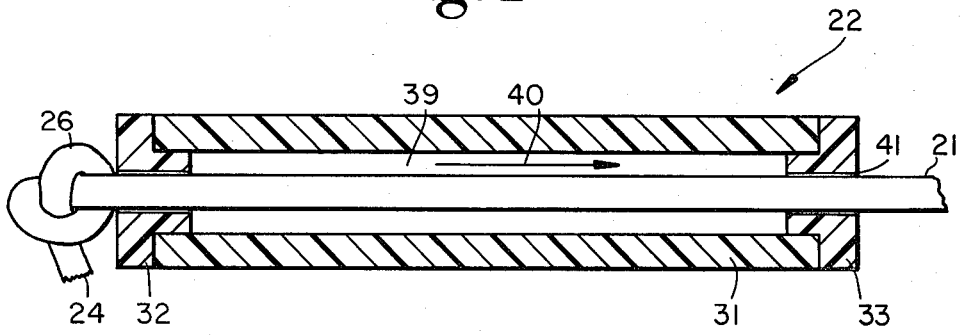
FIG. 2 is a side elevation view in full section of one handlegrip member of the FIG. 1 skip rope.
Figure 4:
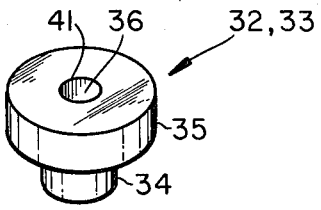
FIG. 4 is a perspective view of a bearing member comprising a portion of the FIG. 1 skip rope.

Referring to FIG. 2, one handlegrip member 22 is illustrated in full section view. Handlegrip member 22 includes a hollow, cylindrical tubular main body portion 31 and two bearing end plugs 32 and 33. A typical bearing end plug is illustrated in perspective view in FIG. 4 and includes a reduced diameter plug portion 34, an enlarged-diameter head portion 35, and a clearance aperture 36 which is only slightly larger than the outside diameter of the length of rope. Clearance aperture 36 extends completely through the corresponding end plug. It is to be understood that the outside diameter of the plug portion 34 and the inside diameter of main body portion 31 are nearly equal to each other yet the plug portion is slightly larger so that when inserted into the main body portion there is a force or press fit. Due to the fact that the bearing end plugs and the main body portion are of plastic or synthetic material, several thousandths of an inch difference in the diameter dimensions can be accommodated by the force fit without any difficulties. This is due to the fact that there will be a certain elasticity or give to each of the component parts and thus, a wider tolerance range is permissible which would otherwise not be possible with metal or wooden parts. The outside diameter of the enlarged head portion 35 is nearly equal to the outside diameter of main body portion 31 so as to provide a generally flush and cylindrical external appearance to the entire handlegrip member. Also illustrated in FIG. 2 is a segment of rope 21 as it passes through the handlegrip member and is knotted at knot location 26 so that the free end 24 cannot be pulled back through the handlegrip member.

Although clearance void 39 which is defined by the cylindrical walls of main body portion 31 is larger than the clearance aperture 36 through each of the bearing end plugs, it should be understood that the actual rope and handle interface is located at clearance aperture 36 and main body portion 31 is not involved directly with any interface with the rope. Although a force or press fit is deemed more than adequate under the circumstances and conditions of use, alternative joining techniques are envisioned. However, it should be pointed out that the force exerted on rope 21 is in the direction of arrow 40 and thus this force vector actually pulls bearing end plug 32 into main body portion 31 via the knot at location 26, thus preventing any loosening of plug 32. Similarly, when the skip rope 20 is in use, the force vector acting on bearing end plug 33 will not necessarily coincide with the direction of arrow 40. Rather, the force vector will be more normal to the direction of arrow 40 and actually causes the length of rope to apply abrasive pressure to the inside diameter edge 41 of clearance aperture 36. As one uses the skip rope, it should be apparent from the normal positioning of the handlegrip members and the movement or travel of the rope that the rope will circle around diameter edge 41 repeatedly and in fairly rapid succession. For this reason, it is very important that the materials selected for rope 21 and the bearing end plugs be compatible to each other such that there is a somewhat lubricated sliding motion between the two rather than any actual friction or abrasion. In this regard, there is a variety of material combinations for the main body portion, the bearing end plugs and the length of rope which will satisfy the necessary self-lubricating relationship. Although polypropylene material could be used for all three component parts of skip rope 20, nylon for all three component parts very likely provides one of the better self-lubricating arrangements. Similarly, a main body portion and bearing end plug combination of nylon with a length of polypropylene rope also is very good as to self-lubricating properties. One concern or possible drawback with the use of nylon is its cost and its availability in conventional material shapes. For this reason, it is believed preferred to select a polyvinylchloride (PVC) tubing for the main body portion and to use nylon for the bearing end plugs. Since there is no abrasive interface between the main body portion and the rope, it is not critical for the main body portion to be constructed of nylon. Rather, the usage of nylon may be limited to the bearing end plugs and still achieve the desirable self-lubricating benefits. It is felt that in this combination a polypropylene rope is preferred over that of nylon due to its material properties and characteristics relative to the other parts.

Figure 3:
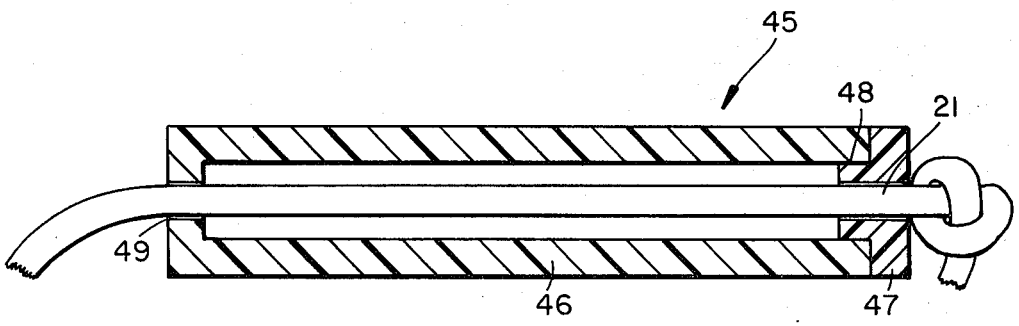
FIG. 3 is a front elevation view in full section of an alternative handlegrip member also suitable for use as part of the FIG. 1 skip rope.

With the foregoing understanding regarding the construction and material options for the present invention, FIG. 3 discloses an alternative construction concept for the handlegrip members. Alternative handlegrip member 45 includes a main body portion 46 and a single bearing end plug 47. Since this illustration is in full section, it should be understood that main body portion 46 includes a larger clearance aperture 48 to receive the bearing end plug 47 and a smaller clearance aperture 49 to receive the length of rope 21. In this particular arrangement, the knotted portion of the rope may be placed at either end of the alternative handlegrip member. If the knot is located adjacent the bearing end plug as illustrated in FIG. 3, then the material for the bearing end plug may be any one of a variety of synthetic or plastic materials. However, in this arrangement the main body portion 46 should be constructed of nylon inasmuch as clearance aperture 49 provides the interface surface between the main body portion and the length of rope and thus nylon is necessary in order to provide the good self-lubricating properties between these two materials. The length of rope should be constructed of polypropylene as has been previously described. On the other hand, if the knotted portion of the length of rope is disposed adjacent the opposite end near clearance aperture 49, then the main body portion may be constructed of PVC tubing or a similar synthetic material and the bearing end plug is constructed of nylon.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A skip rope with handles at each end, each of said handles having a longitudinal axis and comprising:

a length of rope having two free ends;

a pair of hollow, generally cylindrical handlegrip members open at each end and each having an outside diameter gripping surface and an inside diameter surface which defines a skip rope-receiving region;

a pair of substantially identical shouldered, generally cylindrical bearing members assembled to each of said handlegrip members, each bearing member being arranged with a reduced-diameter plug portion whose outside diameter measurement is substantially equal to the measurement of said inside diameter surface and an enlarged-diameter head portion whose outside diameter measurement is substantially equal to the measurement of said outside diameter gripping surface and is adapted to be received by said handlegrip member, each of said bearing members defining a through hole adapted to receive said skip rope; and said length of rope being threaded through each generally cylindrical bearing member and the free ends of said rope being knotted into a diameter size which is greater than the diameter size of said corresponding through hole, the material of said bearing members and the material of said length of rope having a self-lubricating relationship to each other.

2. The skip rope of claim 1 wherein said handlegrip member is constructed of nylon and each of said bearing members is constructed of nylon.

3. The skip rope of claim 1 wherein said handlegrip member is constructed of polypropylene material and each of said bearing members is constructed of nylon.

4. The skip rope of claim 1 wherein said handlegrip member is constructed of polyvinylchloride and each of said bearing members is constructed of nylon.

5. The skip rope of claim 1 wherein each handlegrip member is constructed of polyvinylchloride, each shouldered bearing member is constructed of nylon and said length of rope is constructed of polypropylene.

* * * * *